US005143670A

United States Patent [19]

De Buzzaccarini

[11] Patent Number: 5,143,670

[45] Date of Patent: Sep. 1, 1992

[54] SLAB SHAPED BUILDING COMPONENTS AND METHOD OF FORMING SAME

[75] Inventor: Ferdinando De Buzzaccarini, West Vancouver, Italy

[73] Assignee: Massachusetts Institute of Technology, Cambridge, Mass.

[21] Appl. No.: 382,803

[22] Filed: Jul. 19, 1989

[30] Foreign Application Priority Data

Jul. 19, 1988 [IT] Italy ..... 21413 A/88

[51] Int. Cl.[5] ..... B28B 1/16

[52] U.S. Cl. ..... 264/113; 264/256

[58] Field of Search ..... 264/113, 256, 271.1, 264/273, 308; 52/612

[56] References Cited

U.S. PATENT DOCUMENTS 2,268,965 1/1942 Schumann ..... 264/256

3,967,005 6/1976 Cattaneo ..... 427/202

4,411,723 10/1983 Takeuchi ..... 264/256

*Primary Examiner*—Michael Safavi

*Attorney, Agent, or Firm*—Thomas J. Engellenner

[57] ABSTRACT

Thermally and acoustically insulating, water-repellent, fire resistant, slab-shaped building components are formed by wetting a plurality of expanded polystyrene beads with water and water-soluble synthetic resin, to coat the beads adding an inert filler drying and/or polymerizing the resin and mixing the thus-coated beads with predetermined proportions of cement, sand, fluidifying additive and water and also stearate. The thus-obtained mixture is put into a slab-shaped form and reinforcing components are immersed in the form. The mixture is cured and a thus-formed slab-shaped element is withdrawn from the form.

7 Claims, 2 Drawing Sheets

SLAB SHAPED BUILDING COMPONENTS AND METHOD OF FORMING SAME

The present invention relates to thermally and acoustically insulating, water-repellent, slab-shaped building components and to methods of forming such slab-shaped elements.

BACKGROUND OF THE INVENTION

As is well known, building components made of cement must generally meet special requirements for mechanical strength, compressive, tensile and bending stresses and also for nail-pull resistance, compactness, impermeability, adhesiveness to wall surfaces, volumetric stability during setting and hardening, and durability, i.e. of resistance for a long time to environmental conditions which sometimes are particularly severe.

Recently, moreover, in the place of the traditional light mortars for plasters, cementitious materials are used, which contain polystyrene beads previously coated with resins or glues and a filler to make then rough and which provide lighter products for application to the bearing surfaces of buildings, such products being endowed with good characteristics of thermal and acoustic insulation and water-repellency. These cementitious products are effectively used mainly as additional components, with the purpose of increasing the thermal and acoustic insulation and the water-repellency characteristics of slabs or bearing panels or masonry constructions, mainly in countries with extremely sharp temperature fluctuations, and therefore with frequent freeze-thaw cycles.

For example, in U.S. Pat. No. 3,967,005, issued Jun. 29, 1976 to Mario Cattaneo, there is disclosed a method of and apparatus for enveloping pellets of foamed polystyrene in which the pellets are mixed in a mixing unit with water and synthetic resin and, subsequently, with an inert filler, and then passed to a heating zone for drying and/or polymerization.

Normally, in prefabricated buildings, particularly in northen countries, the walls of those buildings are composed of various layers of materials, in a well known way, at least one of which comprises a cementitious product containing coated polystyrene beads for the purpose of substantially improving the insulating characteristics of the walls, as can be shown by experimental and practical tests.

Such cementitious products, however, must necessarily be applied only as additional materials combined with the bearing elements of the prefabricated buildings, with a consequential increase of the manufacturer's time costs.

BRIEF SUMMARY OF THE INVENTION

It is accordingly an object of the present invention to mitigate the above disadvantages by providing a novel and improved process for the forming of slab-shaped building components which can be used as structural bearing elements in buildings.

It is a further object of the present invention to provide a process for the manufacturing of slab-shaped building elements endowed with good characteristics of thermal and acoustic insulation and of water-repellency, and slab-shaped components formed by such process, which substantially reduce the manufacturing times and the costs of prefabricated buildings.

It is a still further object of the present invention to provide a process for the manufacturing of slab-shaped building elements endowed with high characteristics of thermal and acoustic insulation, and of water-repellency, and slab-shaped elements produced by such process, such that the slabs can be easily cut and therefore can be adapted as needed, as well as being highly resistant to bending stresses.

Yet another object of this invention is to provide a process for the manufacturing of slab-shaped building components endowed with high characteristics of thermal and acoustic insulation and water-repellency, and slab-shaped elements produced by such process, which avoid cracking in response to thermal gradient variations, and which furthermore present excellent characteristics for holding nails, screws and the like without chipping and of fire resistance.

According to the present invention, a process for the formation of thermally and acoustically insulating, slab-shaped building elements comprises the steps of wetting a plurality of expanded polystyrene beads with water and with water-soluble synthetic resins, in a quantity proportional to the plurality of beads, adding an inert filler to the wet beads, drying and/or polymerizing the synthetic resin on the surfaces of the beads in order to allow the filler to keep the beads rough, mixing the plurality of coated beads with predetermined percentages of cement, sand, fluidifying additives and water, placing the resulting mixture into a form, immersing reinforcing components at a predetermined depth in the mixture in the form, curing the mixture and withdrawing a thus-formed slab-shaped element from the form.

The slab-shaped building components according to the present invention comprise a substantially central layer of a substance containing predetermined proportions of a plurality of coated polystyrene beads mixed with cement, sand, fluidifying additives and water, the layer being contained between first and second pieces of non-metallic mesh material, both of which are coated, on their sides opposite from the central layer, with a thin layer of the same substance.

BRIEF DESCRIPTION OF THE DRAWING

Further objects, features and advantages of the present invention will appear from the following description of a preferred, but not exclusive, method of forming slab-shaped building components, and of embodiments of the building components themselves, illustrated as indicative and not restrictive examples in the accompanying drawings, wherein.

THE PREFERRED EMBODIMENTS

Figure 1:
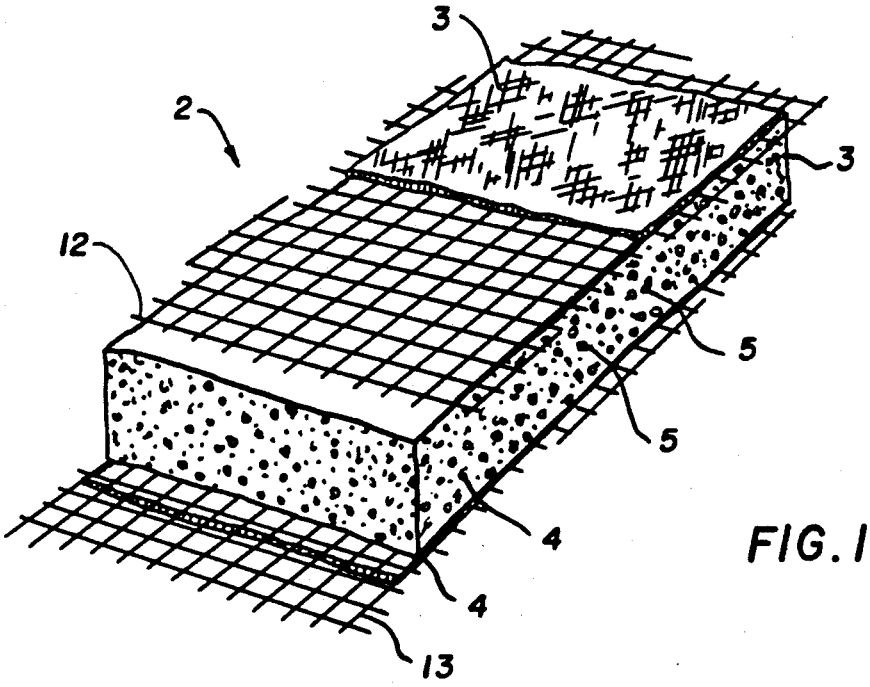
FIG. 1 is a view in perspective, partially broken-away, of a slab having a high thermal and acoustic insulation and fire resistance, according to the present invention.
Figure 2:
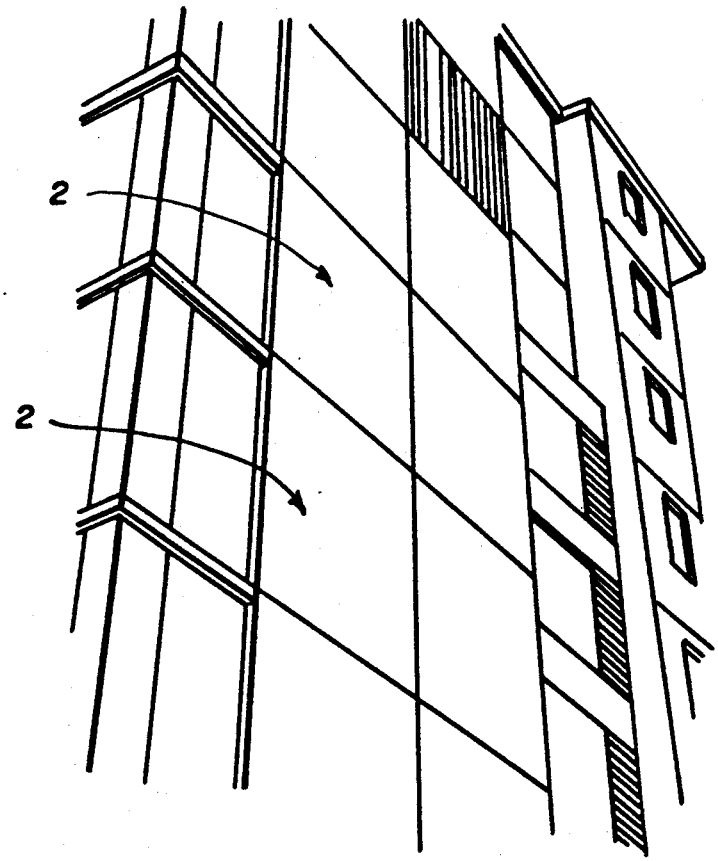
FIG. 2 shows the application of slabs or panels as bearing components in a building.

With reference to the drawings, the process according to the invention is performed by means of the following successive step.

Initially, a predetermined amount of expanded polystyrene beads are moistened with water and water-soluble synthetic resin, in a quantity proportional to that of the beads utilized.

Preferably, the resins are composed by vynilic resins, activated with a synthetic reagent capable to facilitating the dispersion of the resins in the water.

After beads have been moistened in this way, a predetermined proportion of an inert filler is added.

The beads are then dried and/or polymerized, for example by means of infra-red rays or another heat source or a red light source.

The coated beads obtained in this way are subsequently mixed with predetermined percentages of cement, sand, fluidifying additives and water to provide a mixture which is placed in a form and within whose mass the beads, because of their particular coating, become uniformly dispersed.

Reinforcing components are then immersed to a predetermined depth in the mixture obtained in this way and contained in the form. After its mixture has cured, the thus-formed slab-shaped element is removed from the form in order to be utilized as a component of a building.

More particularly, the reinforcing components, in one embodiment, comprise first and second pieces of mesh material, e.g. fiberglass nets or plastic nets, which have been treated make them alkali-resistant, so that they do not deteriorate when placed in the cement mixture, and fire-resistant but which nevertheless can easily be cut so as to adapt them as needed during the installation.

When the cement mixture containing the beads has been prepared, a thin layer of the mixture is spread in a form and over this layer the first piece of mesh material is laid. The first piece is then totally covered by putting in the form another predetermined quantity of the mixture and soon afterwards this is covered by the second piece of mesh material.

A thin layer of the cementitious mixture is then spread over the second piece of mesh material, or otherwise the latter is slightly pressed into the cementitious mass.

The mixture is then cured, for example by steam, and when the curing phase is ended, a thus-formed sheet is withdrawn from the form. This sheet is not intended for bearing loads and may be relatively thin, e.g. ½ through ¾ or more inch, and used e.g. for cladding and any interior or exterior surfaces. In particular, it can be employed in place of drywall gypsum board and other similar products.

Advantageously, the cementitious sheet product obtained in this way contains a predetermined quantity of olefinic compounds in the form of small fibers, for example polypropylene fibers, which counteract cracking and provide shear-reinforcement.

Moreover, the mixture from which the sheet is composed may also contain a predetermined percentage of water-repellent agents, such as, for example, stearates, which are capable of providing the finished product with high water-repellency. Preferably, the mixture contains 0.2 through 10% stearate by weight of the cement in the form of calcium stearate or another suitable stearate, e.g. aluminum stearate.

It has been found that the proportions of the cementitious mixture may be varied within the following proportions:

Coated polystyrene beads—40 through 70 liters
Cement—10 through 50 kilograms
Sand—10 through 40 kilograms
Fluidifying additives—0.04 through 0.06 kilograms
Water—5 through 35 liters As an example, but not a restriction, the mixture according to the present invention used for panels for buildings is composed in the proportions of approximately 58 liters coated polystyrene beads, 35 kg. cement, 29 kg. sand, 50 g fluidifying additives, 40 g. small fibers and 18 liters water.

In the case of panel components which are to be used as load-bearing panels, the reinforcing elements are composed by horizontal and vertical reinforcement bars immersed in the mixture when it is poured into suitable forms.

Slab-shaped elements embodying the present invention are indicated generally by reference numeral 2 in the accompanying drawings.

More particularly, in the case of the above-described sheets, the elements 2 include a middle layer 3 (FIG. 1) of a product containing, in predetermined percentages, a plurality of small coated polystyrene beads 4, mixed with cement, sand, fluidifying additives, water and small polypropylene fibers 5, together with stearate, as described above.

The middle layer is suitable contained between first and second pieces of mesh material, e.g. fiberglass nets 12 and 13, which are both coated, at the sides thereof opposite from the middle layer, with a thin coat of the same mixture.

The mesh material is, if necessary, pre-treated to render it alkali-resistant and fire-resistant. If required, the mesh material may be employed in the form of a metallic mesh material.

Figure 3:
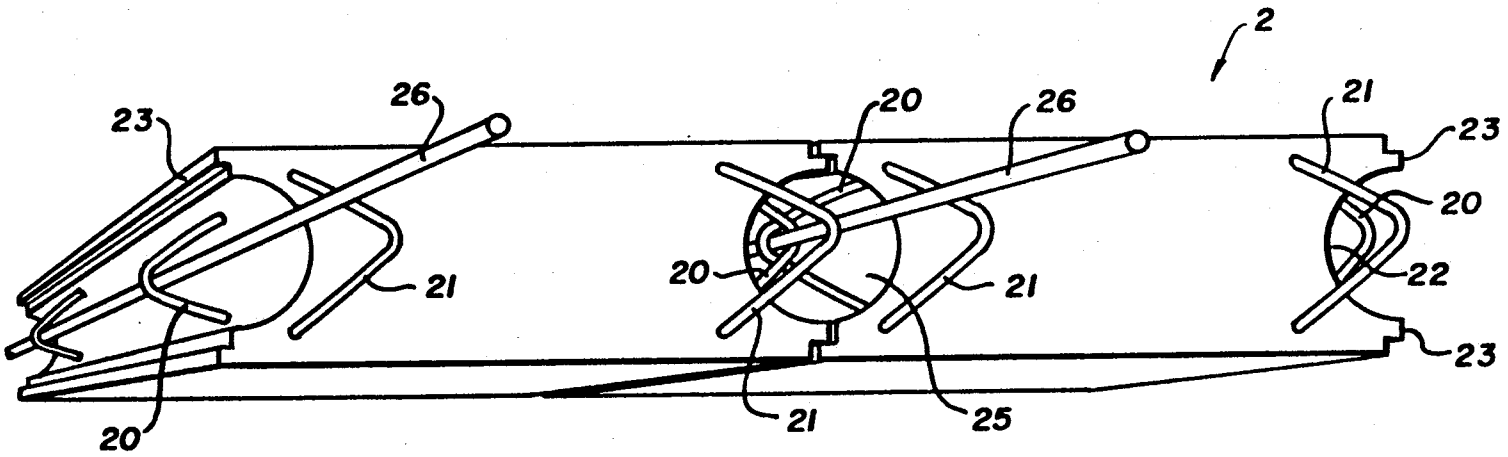
FIG. 3 is a perspective view of a structural bearing panel having a high thermal and acoustic insulation.
Figure 4:
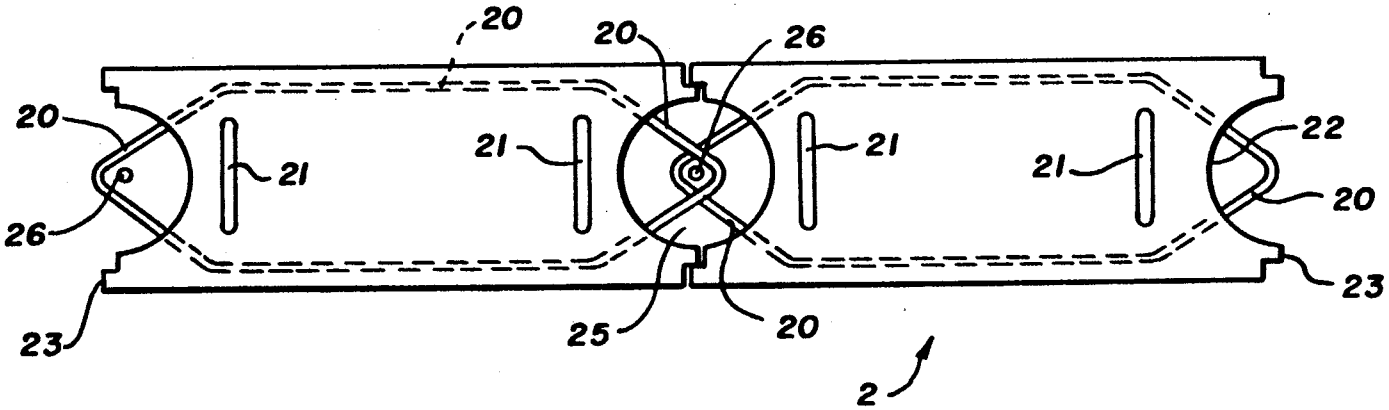
FIG. 4 is a view from above of the panel shown in FIG. 3.

In the case of slabs 2 of greater thickness, and therefore having a panel-like shape, the reinforcing components, as shown in FIGS. 3 and 4, comprise horizontal reinforcement bars 20 and vertical reinforcement bars 21. Furthermore, the panels have lateral concave surfaces 22, whose edges 23 are preferably shaped, on the opposite sides of the panels, as male and female.

The panels are formed so that the reinforcement rods 20 and 21 project form the panels, the projecting portions of these rods having subsequently used to secure the panels to one another and to the building More particularly the vertical securement of the panels to lower and upper concrete reinforcement collars is effected by means of vertical rods 26 extending through the centre of openings 25 defined by the surface 22 of adjacent panels. The rods 26 interengage with portions of the rods 20 extending into the openings 25 and thereby secure the adjacent panels horizontally to one another.

It has been found in practice that the process for the forming of the present slab-shaped building components having high characteristics of thermal and acoustic insulation and of water-repellency, and the slab-shaped components produced by the process, provide particularly advantageous thermal and acoustic insulation and water-repellency for structural elements suitable for construction, for example, of passages with substantial traffic in zones with frequent sudden changes of temperature, and for large reinforced concrete structures like, for instance, bridges, in which the present components provide high characteristics for dampening vibrations due to the road traffic, building structures, for which good thermal insulation is provided, and dams for artificial basins. The present components also substantially reduce the formation of cracks due to the frequent freeze-thaw cycles or to high thermal gradients. Moreover, the present slab-shaped components may be installed during rain or other poor weather, since they are already pre-formed and cured.

The above-described invention is susceptible of numerous modifications and variations, all of which are included in the ambit of the invention as defined by the appended claims. Moreover, all the above-described details are replaceable by technically equivalent elements.

I claim:

1. A process for forming slab-shaped building components, comprising the steps of:

wetting a plurality of expanded polystyrene beads with water and water-soluble synthetic resin, in a quantity proportional to the amount of said beads, to coat said beads;

adding an amount of an inert filler proportional to the amount of beads;

at least one of the steps of drying and polymerizing said beads mixing said coated beads with predetermined proportions of cement, sand, fluidifying additive and water to form a mixture;

placing a layer of the mixture in a form;

laying a first piece of mesh material on said layer;

covering said first piece of mesh material by introducing into said form a predetermined additional quantity of the mixture;

laying on top of said additional quantity a second piece of mesh material;

covering said second mesh material with said mixture in said form;

curing said mixture; and withdrawing a thus-formed slab-shaped element from said form.

2. A process according to claim 1, which includes adding polyolefinic compound fibers to said mixture.

3. A process according to claim 2, which includes employing polypropylene as said fibers.

4. A process according to claim 1, which includes incorporating a predetermined amount of stearate in said mixture.

5. A process according to claim 1, which includes treating said mesh material to render said material fiber alkali-resistant.

6. A process according to claim 3, which includes treating said mesh material to render said mesh material fire-resistant.

7. A process according to claim 1, which includes composing said mixture in the proportion of 40 through 70 liters of said coated polystyrene beads, 10 through 50 kilograms of said cement, 10 through 40 kilograms of said sand, 0.04 through 0.06 kilograms of said fluidifying additives and 5 through 35 liters of water.

* * * * *

UNITED STATES PATENT AND TRADEMARK OFFICE

CERTIFICATE OF CORRECTION

PATENT NO. : 5,143,670

DATED : September 1, 1992

INVENTOR(S) : Ferdinando De Buzzaccarini

It is certified that error appears in the above-indentified patent and that said Letters Patent is hereby corrected as shown below:

On the Title Page, Item [73] should read:
ISOREN ANSTALT of Lugano, Switzerland

Signed and Sealed this

Twenty-first Day of June, 1994

*Attest:*

Bruce Lehman

BRUCE LEHMAN

*Attesting Officer*

*Commissioner of Patents and Trademarks*